US009342048B2

(12) United States Patent
Sasaki

(10) Patent No.: US 9,342,048 B2
(45) Date of Patent: May 17, 2016

(54) IMAGE-FORMING APPARATUS AND IMAGE-FORMING METHOD

(71) Applicant: Yoshinori Sasaki, Kanagawa (JP)

(72) Inventor: Yoshinori Sasaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/718,155

(22) Filed: May 21, 2015

(65) Prior Publication Data

US 2015/0346684 A1 Dec. 3, 2015

(30) Foreign Application Priority Data

May 29, 2014 (JP) ..... 2014-111036

(51) Int. Cl.
*G03G 15/00* (2006.01)
*G03G 21/20* (2006.01)

(52) U.S. Cl.
CPC ..... *G03G 21/203* (2013.01)

(58) Field of Classification Search
CPC ..... G03G 21/203
USPC ..... 399/44
See application file for complete search history.

(56) References Cited

FOREIGN PATENT DOCUMENTS

JP 2000-293068 10/2000

*Primary Examiner* — David Bolduc
*Assistant Examiner* — Barnabas Fekete
(74) *Attorney, Agent, or Firm* — Harness, Dickey & Pierce, P.L.C.

(57) ABSTRACT

An image-forming apparatus include an image bearer; a cleaning device to clean a surface of the image bearer; an air-blowing device to blow outside air; a temperature/humidity detector to detect temperature and humidity outside of the image-forming apparatus; and a controller to determine absolute humidity from detected temperature and humidity. Based on the absolute humidity, a waiting time from a time when a previous image-forming operation ends until the air-blowing device stops, in a stand-by state of an image-forming operation, and an unused time from a time when the air-blowing device stops until the air-blowing device resumes, the controller determines whether or not a polishing operation of the image bearer by the cleaning device after the air-blowing device is unused is executed in starting the operation of the blowing device.

9 Claims, 12 Drawing Sheets

FIG.9

[TABLE 1 CRITERIA FOR DETERMINING ABSOLUTE HUMIDITY]

| HUMIDITY / TEMPERATURE | LESS THAN OR EQUAL TO 35 % | 35.1 TO 40 % | 40.1 TO 45 % | 45.1 TO 50 % | 50.1 TO 55 % | 55.1 TO 60 % | 60.1 TO 65 % | 65.1 TO 70 % | 70.1 TO 75 % | 75.1 TO 80 % | 80.1 TO 85 % | 85.1 TO 90 % | 90.1 TO 95 % | 95.1 TO 100 % |
|---|---|---|---|---|---|---|---|---|---|---|---|---|---|---|
| EQUAL TO OR MORE THAN 34 ℃ | 13.2 | 15 | 16.9 | 18.8 | 20.7 | 22.6 | 24.4 | 26.3 | 28.2 | 30.1 | 32 | 33.8 | 35.7 | 37.6 |
| 32 TO 33.9 ℃ | 11.8 | 13.5 | 15.2 | 16.9 | 18.5 | 20.2 | 21.9 | 23.6 | 25.3 | 27 | 28.6 | 30.3 | 32 | 33.7 |
| 30 TO 31.9 ℃ | 10.6 | 12.1 | 13.6 | 15.2 | 16.7 | 18.2 | 19.7 | 21.2 | 22.7 | 24.2 | 25.8 | 27.3 | 28.8 | 30.3 |
| 28 TO 29.9 ℃ | 9.5 | 10.9 | 12.2 | 13.6 | 15 | 16.3 | 17.7 | 19 | 20.4 | 21.8 | 23.1 | 24.5 | 25.8 | 27.2 |
| 26 TO 27.9 ℃ | 8.5 | 9.8 | 11 | 12.2 | 13.4 | 14.6 | 15.9 | 17.1 | 18.3 | 19.5 | 20.7 | 22 | 23.2 | 24.4 |
| 24 TO 25.9 ℃ | 7.6 | 8.7 | 9.8 | 10.9 | 12 | 13.1 | 14.2 | 15.3 | 16.4 | 17.4 | 18.5 | 19.6 | 20.7 | 21.8 |
| 22 TO 23.9 ℃ | 6.8 | 7.8 | 8.7 | 9.7 | 10.7 | 11.6 | 12.6 | 13.6 | 14.6 | 15.5 | 16.5 | 17.5 | 18.4 | 19.4 |
| 20 TO 21.9 ℃ | 6 | 6.9 | 7.7 | 8.6 | 9.5 | 10.3 | 11.2 | 12 | 12.9 | 13.8 | 14.6 | 15.5 | 16.3 | 17.2 |
| 18 TO 19.9 ℃ | 5.4 | 6.2 | 6.9 | 7.7 | 8.5 | 9.2 | 10 | 10.8 | 11.6 | 12.3 | 13.1 | 13.9 | 14.6 | 15.4 |
| 16 TO 17.9 ℃ | 4.8 | 5.4 | 6.1 | 6.8 | 7.5 | 8.2 | 8.8 | 9.5 | 10.2 | 10.9 | 11.6 | 12.2 | 12.9 | 13.6 |
| 14 TO 15.9 ℃ | 4.2 | 4.8 | 5.4 | 6.1 | 6.7 | 7.3 | 7.9 | 8.5 | 9.1 | 9.7 | 10.3 | 10.9 | 11.5 | 12.1 |
| 12 TO 13.9 ℃ | 3.7 | 4.3 | 4.8 | 5.4 | 5.9 | 6.4 | 7 | 7.5 | 8 | 8.6 | 9.1 | 9.6 | 10.2 | 10.7 |
| 10 TO 11.9 ℃ | 3.3 | 3.8 | 4.2 | 4.7 | 5.2 | 5.6 | 6.1 | 6.6 | 7 | 7.5 | 8 | 8.5 | 8.9 | 9.4 |
| LESS THAN OR EQUAL TO 9.9 ℃ | 2.9 | 3.3 | 3.7 | 4.1 | 4.5 | 5 | 5.4 | 5.8 | 6.2 | 6.6 | 7 | 7.4 | 7.9 | 8.3 |

FIG.10

[TABLE 2 EXECUTION CONDITION FOR POLISHING OPERATION (FIRST EMBODIMENT)]

LESS THAN 12 g/m³

EQUAL TO OR MORE THAN 0 MINUTES

| | | | | | | | | | | | | | | | | | | |
|---|---|---|---|---|---|---|---|---|---|---|---|---|---|---|---|---|---|---|
| VALUES IN RAM153 | ABSOLUTE HUMIDITY | EQUAL TO OR MORE THAN 16 g/m³ | | | | | | | | 12 TO 15.9 g/m³ | | | | | | | | |
| | WAITING TIME | LESS THAN 15 MINUTES | | | | 15 MINUTES | | | | LESS THAN 15 MINUTES | | | | 15 MINUTES | | | | |
| | UNUSED TIME | 0 TO LESS THAN 2 HOURS | 2 TO LESS THAN 4 HOURS | 4 TO LESS THAN 6 HOURS | EQUAL TO OR MORE THAN 6 HOURS | 0 TO LESS THAN 2 HOURS | 2 TO LESS THAN 4 HOURS | 4 TO LESS THAN 6 HOURS | EQUAL TO OR MORE THAN 6 HOURS | 0 TO LESS THAN 2 HOURS | 2 TO LESS THAN 4 HOURS | 4 TO LESS THAN 6 HOURS | EQUAL TO OR MORE THAN 6 HOURS | 0 TO LESS THAN 2 HOURS | 2 TO LESS THAN 4 HOURS | 4 TO LESS THAN 6 HOURS | EQUAL TO OR MORE THAN 6 HOURS | EQUAL TO OR MORE THAN 0 HOURS |
| EXECUTION CONDITIONS FOR POLISHING OPERATION | EXECUTED/ NOT EXECUTED | NOT EXECUTED | EXECUTED | | | NOT EXECUTED | | EXECUTED | | NOT EXECUTED | | EXECUTED | | NOT EXECUTED | | | EXECUTED | NOT EXECUTED |
| | EXECUTION TIME TM [MINUTE] | – | 8 | 8 | 8 | – | – | 8 | 8 | – | – | 8 | 8 | – | – | – | 8 | – |
| | PREDETERMINED TIME T1 [SECOND] | – | 15 | 15 | 15 | – | – | 15 | 15 | – | – | 15 | 15 | – | – | – | 15 | – |
| | PREDETERMINED TIME T2 [SECOND] | – | 45 | 45 | 45 | – | – | 45 | 45 | – | – | 45 | 45 | – | – | – | 45 | – |
| | NUMBER OF ROTATIONS OF BRUSH [RPM] | – | 420 | 420 | 420 | – | – | 420 | 420 | – | – | 420 | 420 | – | – | – | 420 | – |

FIG.11

[TABLE 3 EXECUTION CONDITION FOR POLISHING OPERATION (SECOND EMBODIMENT)]

LESS THAN 12 g/m³

EQUAL TO OR MORE THAN 0 MINUTES

| | | | | | | | | | | | | | | | | | | |
|---|---|---|---|---|---|---|---|---|---|---|---|---|---|---|---|---|---|---|
| VALUES IN RAM153 | ABSOLUTE HUMIDITY | EQUAL TO OR MORE THAN 16 g/m³ | | | | | | | | 12 TO 15.9 g/m³ | | | | | | | | |
| | WAITING TIME | LESS THAN 15 MINUTES | | | | 15 MINUTES | | | | LESS THAN 15 MINUTES | | | | 15 MINUTES | | | | |
| | UNUSED TIME | 0 TO LESS THAN 2 HOURS | 2 TO LESS THAN 4 HOURS | 4 TO LESS THAN 6 HOURS | EQUAL TO OR MORE THAN 6 HOURS | 0 TO LESS THAN 2 HOURS | 2 TO LESS THAN 4 HOURS | 4 TO LESS THAN 6 HOURS | EQUAL TO OR MORE THAN 6 HOURS | 0 TO LESS THAN 2 HOURS | 2 TO LESS THAN 4 HOURS | 4 TO LESS THAN 6 HOURS | EQUAL TO OR MORE THAN 6 HOURS | 0 TO LESS THAN 2 HOURS | 2 TO LESS THAN 4 HOURS | 4 TO LESS THAN 6 HOURS | EQUAL TO OR MORE THAN 6 HOURS | EQUAL TO OR MORE THAN 0 HOURS |
| EXECUTION CONDITIONS FOR POLISHING OPERATION | EXECUTED/ NOT EXECUTED | NOT EXECUTED | EXECUTED | | | NOT EXECUTED | | EXECUTED | | NOT EXECUTED | | EXECUTED | | NOT EXECUTED | | | EXECUTED | NOT EXECUTED |
| | EXECUTION TIME TM [MINUTE] | – | 3 | 5 | 8 | – | – | 3 | 5 | – | – | 3 | 5 | – | – | – | 3 | – |
| | PREDETERMINED TIME T1 [SECOND] | – | 15 | 15 | 15 | – | – | 15 | 15 | – | – | 15 | 15 | – | – | – | 15 | – |
| | PREDETERMINED TIME T2 [SECOND] | – | 45 | 45 | 45 | – | – | 45 | 45 | – | – | 45 | 45 | – | – | – | 45 | – |
| | NUMBER OF ROTATIONS OF BRUSH [RPM] | – | 420 | 420 | 420 | – | – | 420 | 420 | – | – | 420 | 420 | – | – | – | 420 | – |

FIG.12

[TABLE 4 EXECUTION CONDITION FOR POLISHING OPERATION (THIRD EMBODIMENT)]

LESS THAN 12 g/m³

EQUAL TO OR MORE THAN 0 MINUTES

| | | | | | | | | | | | | | | | | | | |
|---|---|---|---|---|---|---|---|---|---|---|---|---|---|---|---|---|---|---|
| VALUES IN RAM153 | ABSOLUTE HUMIDITY | EQUAL TO OR MORE THAN 16 g/m³ | | | | | | | | 12 TO 15.9 g/m³ | | | | | | | | |
| | WAITING TIME | LESS THAN 15 MINUTES | | | | 15 MINUTES | | | | LESS THAN 15 MINUTES | | | | 15 MINUTES | | | | |
| | UNUSED TIME | 0 TO LESS THAN 2 HOURS | 2 TO LESS THAN 4 HOURS | 4 TO LESS THAN 6 HOURS | EQUAL TO OR MORE THAN 6 HOURS | 0 TO LESS THAN 2 HOURS | 2 TO LESS THAN 4 HOURS | 4 TO LESS THAN 6 HOURS | EQUAL TO OR MORE THAN 6 HOURS | 0 TO LESS THAN 2 HOURS | 2 TO LESS THAN 4 HOURS | 4 TO LESS THAN 6 HOURS | EQUAL TO OR MORE THAN 6 HOURS | 0 TO LESS THAN 2 HOURS | 2 TO LESS THAN 4 HOURS | 4 TO LESS THAN 6 HOURS | EQUAL TO OR MORE THAN 6 HOURS | EQUAL TO OR MORE THAN 0 HOURS |
| EXECUTION CONDITIONS FOR POLISHING OPERATION | EXECUTED/ NOT EXECUTED | NOT EXECUTED | EXECUTED | | | NOT EXECUTED | | EXECUTED | | NOT EXECUTED | | EXECUTED | | NOT EXECUTED | | | EXECUTED | NOT EXECUTED |
| | EXECUTION TIME TM [MINUTE] | – | 2 | 4 | 5 | – | – | 3 | 5 | – | – | 3 | 5 | – | – | – | 3 | – |
| | PREDETERMINED TIME T1 [SECOND] | – | 20 | 20 | 20 | – | – | 15 | 15 | – | – | 10 | 10 | – | – | – | 10 | – |
| | PREDETERMINED TIME T2 [SECOND] | – | 40 | 40 | 40 | – | – | 45 | 45 | – | – | 50 | 50 | – | – | – | 50 | – |
| | NUMBER OF ROTATIONS OF BRUSH [RPM] | – | 420 | 420 | 420 | – | – | 420 | 420 | – | – | 420 | 420 | – | – | – | 420 | – |

FIG.13

[TABLE 5 EXECUTION CONDITION FOR POLISHING OPERATION (FOURTH EMBODIMENT)]

LESS THAN 12 g/m³

EQUAL TO OR MORE THAN 0 MINUTES

| | | | | | | | | | | | | | | | | | | |
|---|---|---|---|---|---|---|---|---|---|---|---|---|---|---|---|---|---|---|
| VALUES IN RAM153 | ABSOLUTE HUMIDITY | EQUAL TO OR MORE THAN 16 g/m³ | | | | | | | | 12 TO 15.9 g/m³ | | | | | | | | |
| | WAITING TIME | LESS THAN 15 MINUTES | | | | 15 MINUTES | | | | LESS THAN 15 MINUTES | | | | 15 MINUTES | | | | |
| | UNUSED TIME | 0 TO LESS THAN 2 HOURS | 2 TO LESS THAN 4 HOURS | 4 TO LESS THAN 6 HOURS | EQUAL TO OR MORE THAN 6 HOURS | 0 TO LESS THAN 2 HOURS | 2 TO LESS THAN 4 HOURS | 4 TO LESS THAN 6 HOURS | EQUAL TO OR MORE THAN 6 HOURS | 0 TO LESS THAN 2 HOURS | 2 TO LESS THAN 4 HOURS | 4 TO LESS THAN 6 HOURS | EQUAL TO OR MORE THAN 6 HOURS | 0 TO LESS THAN 2 HOURS | 2 TO LESS THAN 4 HOURS | 4 TO LESS THAN 6 HOURS | EQUAL TO OR MORE THAN 6 HOURS | EQUAL TO OR MORE THAN 0 HOURS |
| EXECUTION CONDITIONS FOR POLISHING OPERATION | EXECUTED/ NOT EXECUTED | NOT EXECUTED | EXECUTED | | | NOT EXECUTED | | EXECUTED | | NOT EXECUTED | | EXECUTED | | NOT EXECUTED | | | EXECUTED | NOT EXECUTED |
| | EXECUTION TIME TM [MINUTE] | – | 2 | 4 | 5 | – | – | 2 | 4 | – | – | 2 | 4 | – | – | – | 2 | – |
| | PREDETERMINED TIME T1 [SECOND] | – | 15 | 15 | 15 | – | – | 15 | 15 | – | – | 10 | 10 | – | – | – | 10 | – |
| | PREDETERMINED TIME T2 [SECOND] | – | 45 | 45 | 45 | – | – | 45 | 45 | – | – | 50 | 50 | – | – | – | 50 | – |
| | NUMBER OF ROTATIONS OF BRUSH [RPM] | – | 630 | 630 | 630 | – | – | 630 | 630 | – | – | 630 | 630 | – | – | – | 630 | – |

IMAGE-FORMING APPARATUS AND IMAGE-FORMING METHOD

CROSS-REFERENCE TO RELATED APPLICATION

The present application is based on and claims priority from Japanese Patent Application Number 2014-111036, filed May 29, 2014, the disclosure of which is hereby incorporated by reference herein in its entirety.

BACKGROUND

The present invention relates to an image-forming apparatus such as a copier, a printer, a fax machine, a plotter device, or an electrophotographic printer used for a multifunctional peripheral of those.

As the above image-forming apparatus, an image-forming apparatus using a corona-charging type charging device as a charging device which charges a surface of a photoconductor as an image bearer is known. In a case of the corona-charging type, ozone and a substance of nitrates as a discharge product generated by corona discharge form a coating film on the photoconductor. When the coating film absorbs moisture in the air, a surface resistance of the photoconductor lowers, a part of, or an entire electrostatic latent image is not maintained and ruined in a surface direction of a surface of the photoconductor, and becomes a blurred image as a letter written in ink on a wet paper. Such a phenomenon is referred to as image deletion.

The image deletion often occurs under the following conditions in which a moisture amount absorbed by a photoconductor is easily increased.

(1) a case where a stop time of the image-forming apparatus is long after the image-forming apparatus operates.

(2) a case where absolute humidity is high in an installation environment of the image-forming apparatus.

In order to release the ozone and the discharge product which cause the image deletion, an air-blowing device which sucks outside air into the charging device, and releases the sucked outside air, the ozone, and the discharge product concurrently is provided in the image-forming apparatus conventionally. The air-blowing device operates when the power of the image forming apparatus is turned off, and except when the image-forming apparatus is in a power-saving mode to which the image-forming apparatus is switched when the power is left on and the image-forming apparatus is unused for a certain time.

In this case, for a certain time after an end of an image-forming operation, the air-blowing device keeps an operating state, and when the certain time elapses after the end of the image-forming operation, the air-blowing device automatically stops, and the image-forming apparatus is switched to the power-saving mode.

However, when an operator turns the power off before the image-forming apparatus is switched to the power-saving mode, there is a case where the air-blowing device does not operate for the certain time after the end of the image-forming operation. In this case, there is a case where release of the ozone and the discharge product is not sufficiently performed, and compared to a case where the air-blowing device operates for the certain time after the end of the image-forming operation, the image deletion tends to occur, and even if a polishing operation of the photoconductor is executed as usual, there is a case where the image deletion occurs.

SUMMARY

An image-forming apparatus according to an embodiment of the present invention include an image bearer; a cleaning device to clean a surface of the image bearer; an air-blowing device to blow outside air; a temperature/humidity detector to detect temperature and humidity outside of the image-forming apparatus; and a controller to determine absolute humidity from detected temperature and humidity. Based on the absolute humidity, a waiting time from a time when a previous image-forming operation ends until the air-blowing device stops, in a stand-by state of an image-forming operation, and an unused time from a time when the air-blowing device stops until the air-blowing device resumes, the controller determines whether or not a polishing operation of the image bearer by the cleaning device after the air-blowing device is unused is executed in starting the operation of the blowing device.

BRIEF DESCRIPTION OF THE DRAWINGS

FIG. 9 is Table 1 which shows criteria for determining absolute humidity.

FIG. 10 is Table 2 which shows execution conditions for a polishing operation in the first embodiment.

FIG. 11 is Table 3 which shows execution conditions for a polishing operation in a second embodiment.

FIG. 12 is Table 4 which shows execution conditions for a polishing operation in a third embodiment.

FIG. 13 is Table 5 which shows execution conditions for a polishing operation in a fourth embodiment.

DETAILED DESCRIPTION OF THE PREFERRED EMBODIMENTS

First Embodiment

Figure 1:
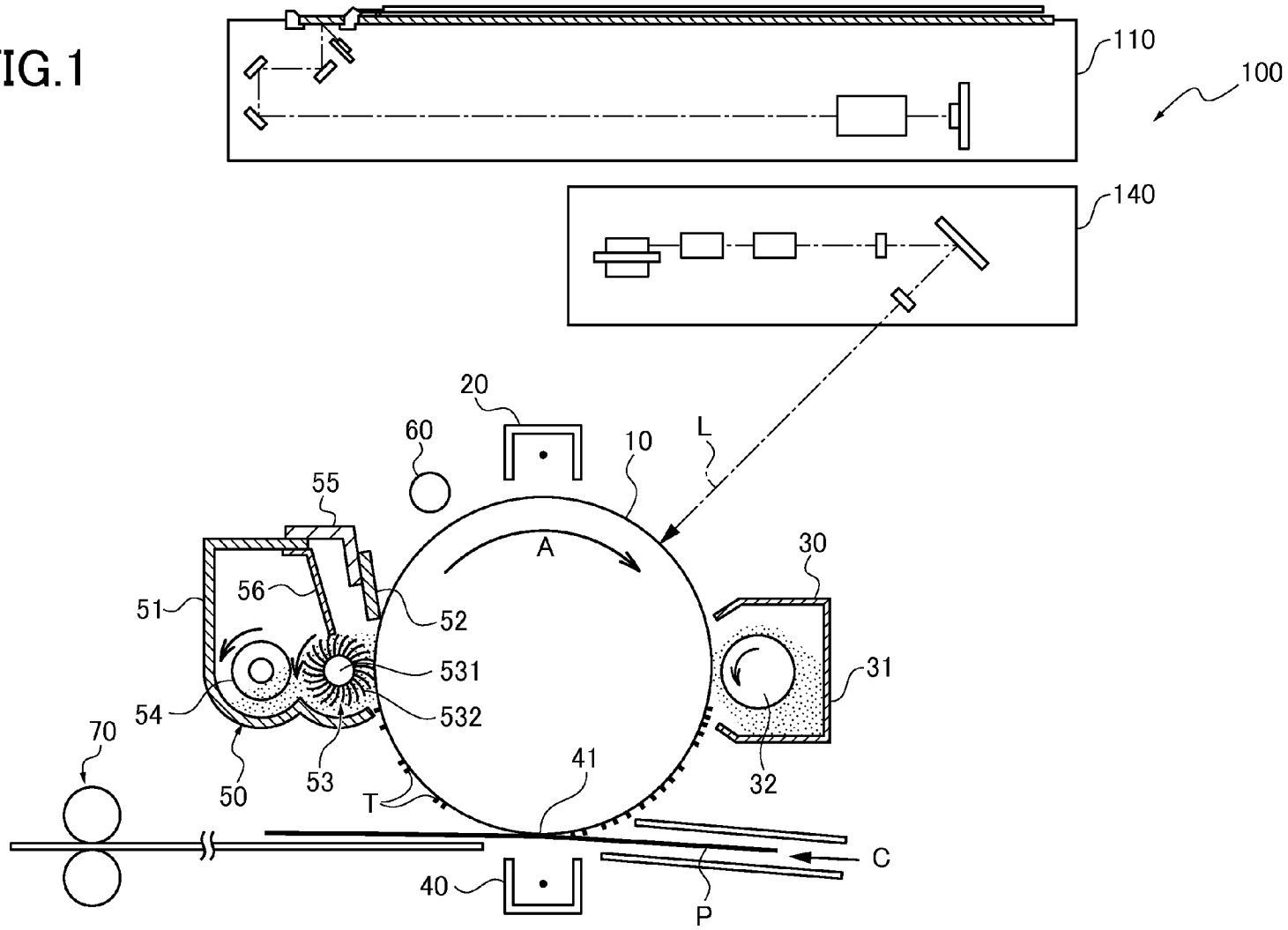
FIG. 1 is a schematic diagram which shows a structure of an image-forming part of an image-forming apparatus according to a first embodiment of the present invention.
Figure 4:
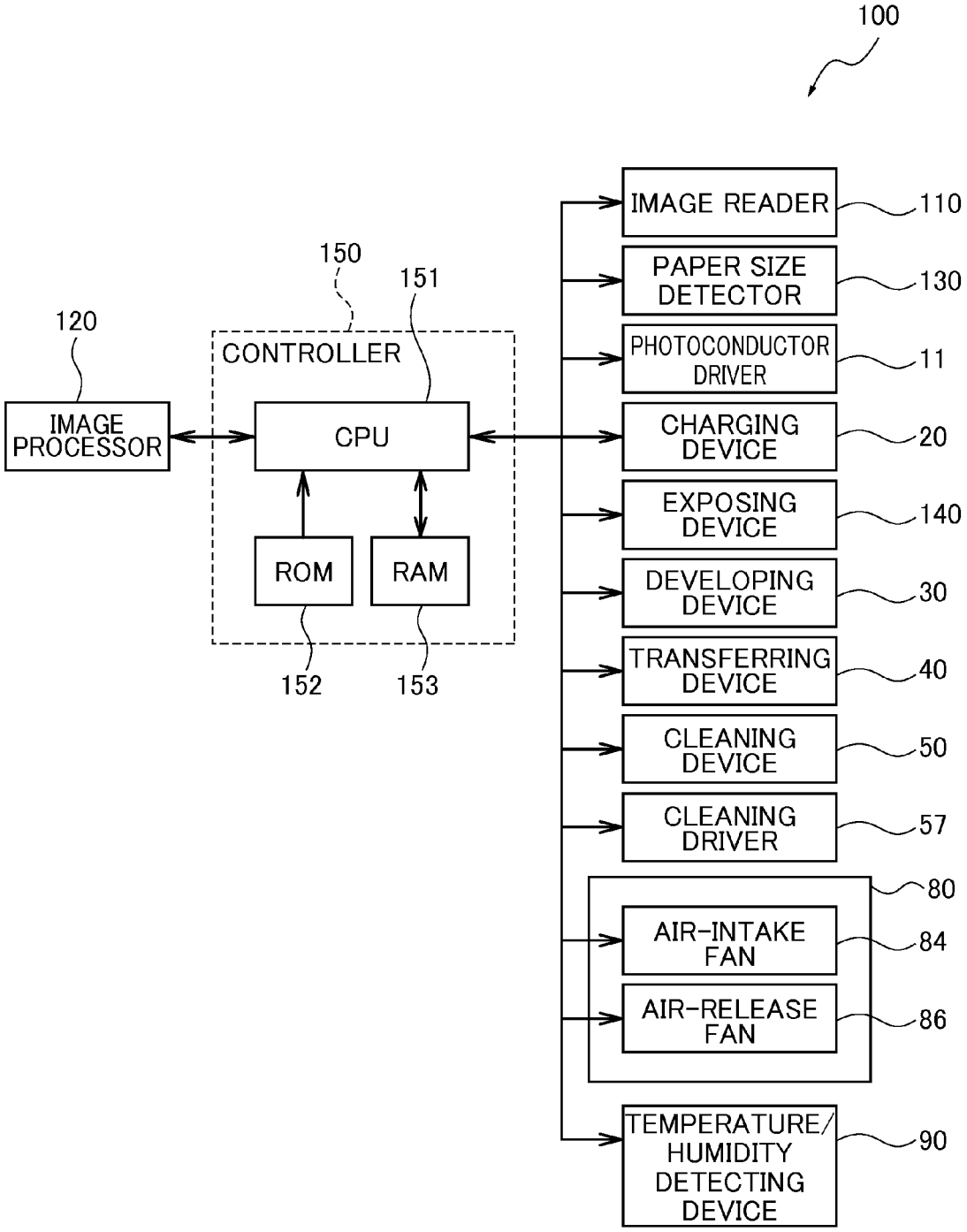
FIG. 4 is a block diagram which shows a structure of the image-forming apparatus according to the first embodiment of the present invention.

A first embodiment of the present invention will be explained hereinafter with reference to the drawings. FIG. 1 is a schematic structure diagram which shows a vicinity of an image-forming part as a chief part of an image-forming apparatus 100 in the present embodiment. FIG. 4 is a block diagram which shows a structure of the image-forming apparatus 100 in the present embodiment. The image-forming apparatus 100 in the present embodiment can be applied to, for example, a monochrome image-forming apparatus which forms only a black toner image on a transfer medium. As shown in FIGS. 1 and 4, the image-forming apparatus 100 in the present embodiment mainly includes an image reader 110, an image processor 120, a paper size detector 130, a photoconductor driver 11, a charging device 20, an exposing device 140 as an electrostatic latent image-forming apparatus, a developing device 30, a transferring device 40, a cleaning device 50, a cleaning driver 57, an air-blowing device 80, a temperature/humidity detecting device 90, and a controller 150.

The image-forming apparatus 100 in the present embodiment further includes a discharging device 60, a fixing device 70 (hereinbefore, see FIG. 1), a paper feeder (not shown) which feeds a transfer paper P as one example of a transfer medium, and a carrying device (not shown) which carries the transfer paper P.

The image reader 110 includes a light source, a plurality of mirrors, an imaging forming lens, and an image sensor such as a CCD image sensor, and the like.

The exposing device 140 includes a polygon mirror, an optical element, and the like, and is constituted as an optical scanning-device using those. Please note that as the exposing device 140, in place of the optical scanning-device, an LED array can be used.

The image-forming part includes a cylindrical photoconductor drum 10 as an image bearer, as shown in FIG. 1. The photoconductor drum 10 includes, for example, an organic photoconductive photosensitive layer, and is rotationally driven in a direction of an arrow A (clockwise) in FIG. 1 by the photoconductor driver 11. The image-forming part is constituted such that around the photoconductor drum 10, along a rotational direction thereof, the charging device 20, a laser beam from the exposing device 140 (exposure), the developing device 30, the transferring device 40, the cleaning device 50, and the discharging device 60 are arranged in order.

The charging device 20 is a device which uniformly charges a surface (circumferential surface) of the photoconductor drum 10, and in the present embodiment, a corona charging type such as a corotron type corona charging device, a scorotron type charging device, or the like is used. Corona discharge is continuous discharge generated by a local air breakdown performed in a non-uniform electric field. Generally, it is structured such that a wire (corona wire) having a minute diameter is put in a sealed case of aluminum or the like, one face of the sealed case is open, and a corona ion is discharged from the open region. Additionally, as a voltage applying to the corona wire increases, a strong electric field is locally formed around the corona wire, a local air breakdown occurs, and discharge continues. This is the corona discharge.

The developing device 30 includes a storage part 31 which stores toner, and a developing roller 32.

The developing roller 32 applies the toner stored in the storage part 31 to an electrostatic latent image on the photoconductor drum 10, and forms a toner image as a developing agent image.

The transferring device 40 is a device which transfers the toner image formed on the photoconductor drum 10 on the transfer paper P, and a corona transfer charger or the like is used. The toner image formed on the photoconductor drum 10 is transferred on the transfer paper P by operation of the transferring device 40 in a transferring part 41 (a position in which the transferring device 40 and the photoconductor drum 10 face each other).

Figure 2:
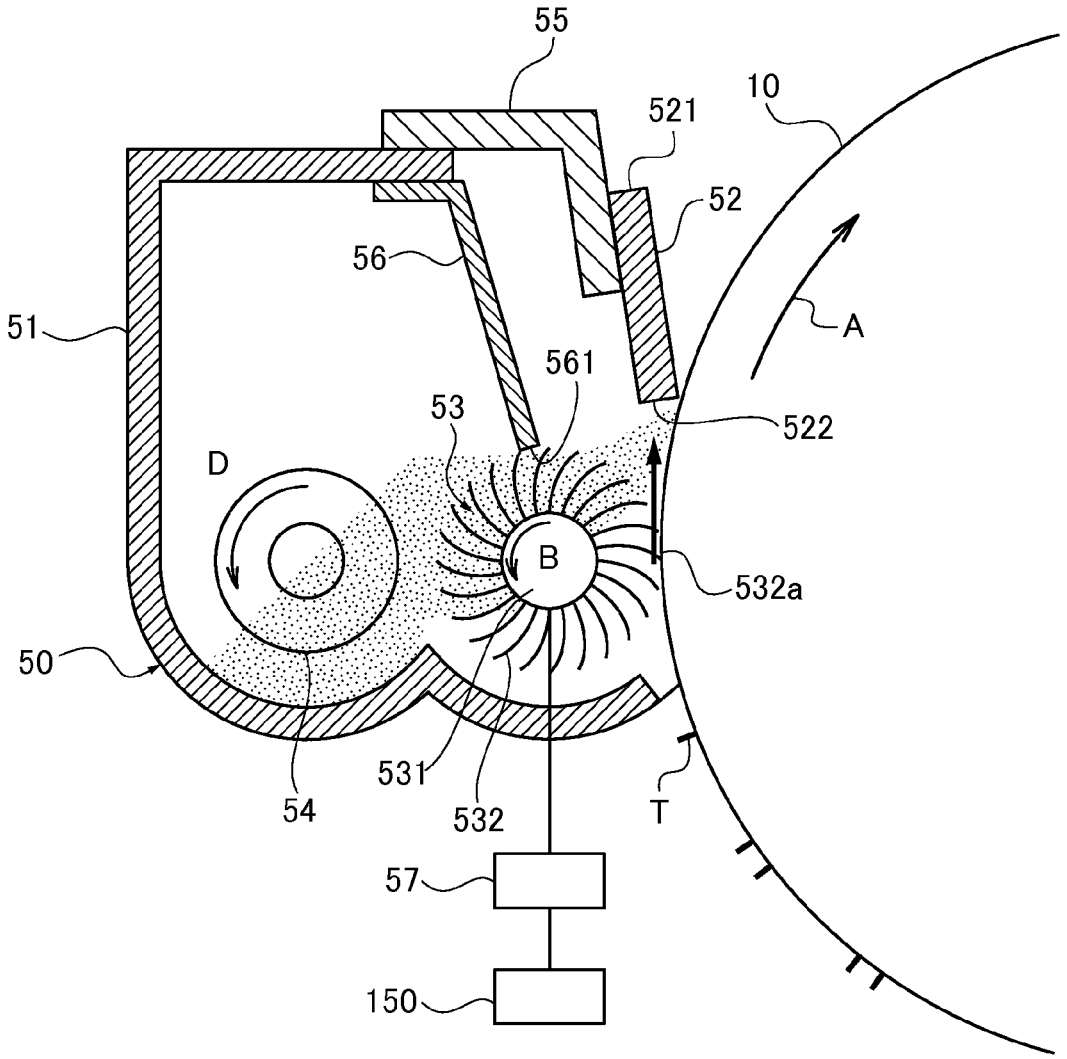
FIG. 2 is an enlarged cross-sectional image which shows a cleaning device of FIG. 1.

The cleaning device 50 is a device which removes transfer residue toner remaining on the surface of the photoconductor drum 10 without being transferred on the transfer paper P by polishing the surface of the photoconductor drum 10 after transferring the toner image. FIG. 2 is a schematic diagram which shows a structure of the cleaning device 50 in the present embodiment. As shown in FIG. 2, the cleaning device 50 in the present embodiment has a cleaning case 51, a cleaning blade 52, a brush roller 53, and a toner-eliminating member 54, and the like.

The cleaning blade 52 is constituted of an elastic material such as rubber or the like, and a base end part 521 thereof is fixedly supported by the cleaning case 51 via an installation bracket 55, and an end edge part 522 on a free end side thereof is pressed against the surface of the photoconductor drum 10.

The brush roller 53 is stored in the cleaning case 51, and has a core shaft 531 which is constituted of a rigid body which extends parallel to the photoconductor drum 10, and a brush 532 which is provided around the core shaft 531. On an inner surface of an upper wall of the cleaning case 51, a flicker bar 56 as a scraping member is fixed, and an end 561 thereof is in contact with the brush 532.

The toner-eliminating member 54 is constituted of, for example, a screw, a coil, or the like, and is rotationally driven in a direction of an arrow D shown in FIG. 2.

The discharging device 60 is a device which removes residue charge of the photoconductor drum 10, and an exposure lamp or the like is used.

The fixing device 70 fixes the toner image transferred on the transfer paper P by pressure, heat, or the like, and is composed of a fixing roller, a pressure roller, or the like.

The temperature/humidity detecting device 90 is a device which detects temperature and humidity in an environment in which the image-forming apparatus 100 is installed, and an emitting infrared radiation-detecting type noncontact temperature sensor, a humidity sensor, or the like is used.

Figure 3:
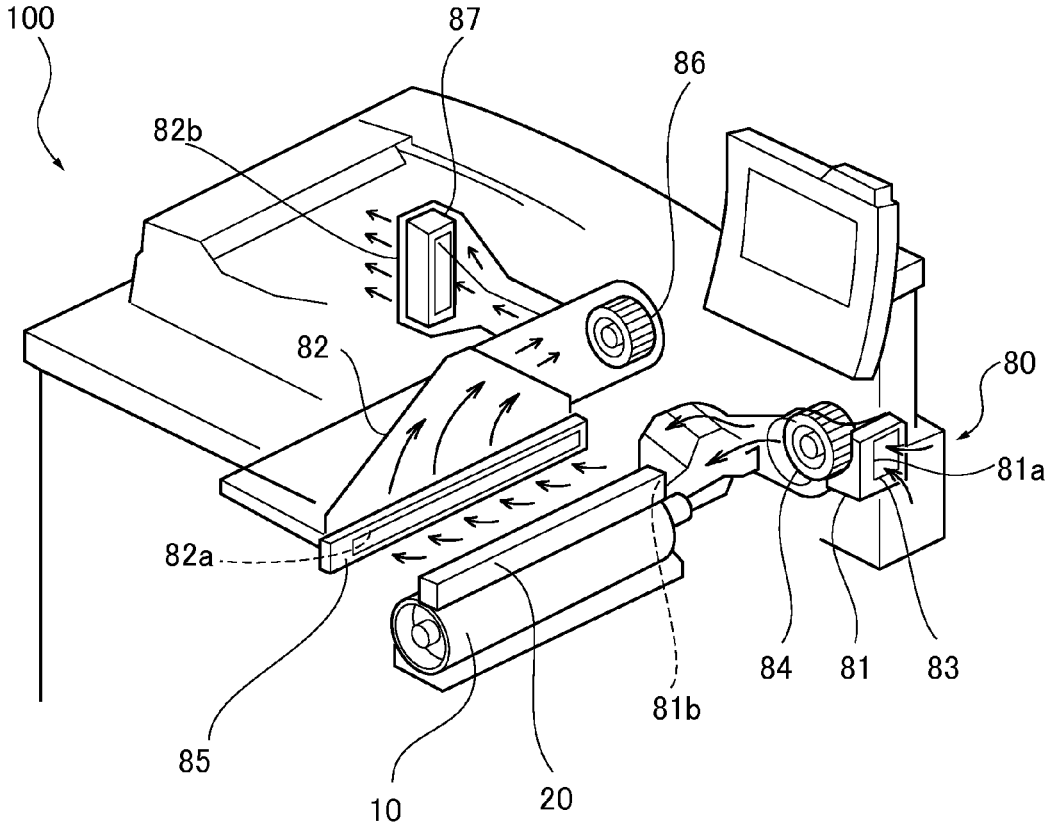
FIG. 3 is a schematic diagram which shows a structure of an air-blowing device.

The air-blowing device 80 is a device which supplies outside air to the charging device 20, and releases air in the charging device 20 to the outside. The air-blowing device 80 releases the ozone and the substance of nitrates as the discharge product generated by the corona discharge in the charging device 20, floating toner, and the like to the outside, and suppresses the image deletion. FIG. 3 is a schematic diagram which shows a structure of the air-blowing device 80 in the image-forming apparatus 100. As shown in FIG. 3, the air-blowing device 80 is constituted of a dustproof filter 83, an air-intake fan 84 as an air blower, a toner filter 85, an air-release fan 86 as an air releaser, an ozone filter 87, and an outside air-introduction duct 81 and an air-release duct 82 which form an airflow path of the sucked outside air and the air.

The outside air-introducing duct 81 includes an air-intake port 81*a* which sucks outside air, and a supplying port 81*b* which supplies the sucked outside air to the charging device 20. Additionally, the air-intake port 81*a* is provided with the dustproof filter 83, which prevents foreign matter such as dust or the like from flowing into the image-forming apparatus 100. The air-intake fan 84 is provided in the outside air-introduction duct 81. The air-intake fan 84 sucks outside air from the air-intake port 81*a*, takes it into the outside air-introduction duct 81, and releases the sucked outside air from the supplying port 81*b* to the charging device 20.

The air-release duct 82 includes a suction port 82*a* which has an approximately same length as a length in an axial direction of the charging device 20, and sucks the air in the charging device 20 and introduces it to the air-release duct 82, and an air-release port 82*b* which releases the outside air sucked in the air-release duct 82 to the outside. The suction port 82*a* is provided with the toner filter 85, and the air-release port 82*b* is provided with the ozone filter 87. The air-release fan 86 is provided in the air-release duct 82, and sucks the air in the charging device 20 from the air-release port 82*a* and takes it into the air-release duct 82, and releases it from the air-release port 82*b*.

Here, in the corona charging type charging device 20, the ozone and the discharge product are generated by the corona discharge while forming an image (while printing). Additionally, around the charging device 20, scattered toners but a very few toners from the developing device 30 float, and there is a case where the toners enter the charging device 20. Therefore, in order to release the ozone, the discharge product, and the toners in the charging device 20, the air-release fan 86 sucks the air in the charging device 20, and flows it to a side of the ozone filter 87 on which the air-release port 82*b* is provided.

By the ozone filter 87, the ozone in the air in the air-release duct 82 is removed. Additionally, toner mixed in the air in the charging device 20 is adsorbed by the air-intake port 82*a* between the charging device 20 and the air-release fan 86.

Please note that when the power of the image-forming apparatus 100 is turned on, and when an operator performs an operation for image formation during a power-saving mode, the air-intake fan 84 and the air-release fan 86 start operating. And when a state where image formation is not performed and a time where the operator does not perform an operation (a stand-by state) exceed a predetermined time, the air-intake fan 84 and the air-release fan 86 stop, and the image-forming apparatus 100 is switched to the power-saving mode.

The controller 150 controls an operation regarding image formation of the image-forming apparatus 100. In particular, the controller 150, as shown in FIG. 4, controls the image reader 110 which reads an image presented in a manuscript as image information, the image processor 120 which processes the image information outputted from the image reader 110, the paper size detector 130 which detects the transfer paper P and a paper size of the manuscript on the image reader 110, the photoconductor driver 11, the charging device 20, the exposing device 140, the developing device 30, the transferring device 40, the cleaning device 50, the cleaning driver 57, and the air-intake fan 84 and the air-release fan 86 of the air-blowing device 80.

Additionally, the controller 150 functions as a waiting time detector which detects a time from when a previous image-forming operation ends until the air-blowing device 80 stops in a stand-by state of an image-forming operation as a waiting time, and an unused time detector which detects a time from when the air-blowing device 80 stops until the air-blowing device 80 resumes as an unused time. Further, the controller 150 also functions as a polishing operation controller which determines absolute humidity from a result of detection of temperature and humidity in the temperature/humidity detecting device 90, and based on the absolute humidity, and the detected waiting time and unused time, controls a polishing operation of the photoconductor drum 10 after being unused.

Here, the stand-by state is a state from when the image-forming operation ends until the image-forming apparatus 100 is switched to the power-saving mode, and is referred to as a state where the image-forming operation can be immediately started by an operation by an operator, or the like. A state of being unused is referred to as a state where the image-forming operation ends, and the power of the image-forming apparatus 100 is turned off, or the image-forming apparatus 100 is switched to the power-saving mode, and image formation is not executed, that is, a state where the image-forming apparatus 100 is unused. Additionally, the polishing operation of the photoconductor drum 10 after being unused is referred to as an operation in which when the image-forming apparatus 10 becomes the stand-by state where image formation is possible again from the state of being unused by turning the power on again, or the operation by the operator during the power-saving mode, before executing the image-forming operation, a toner image is formed on the photoconductor drum 10, and the photoconductor drum 10 is polished and cleaned by the cleaning device 50.

The controller 150 is constituted of, for example, in addition to a CPU (Central Processing Unit) 151, memories such as a ROM (Read Only Memory) 152, a RAM (Random Access Memory) 153, and the like. However, a structure of the controller 150 in the present embodiment is not limited thereto, and it can be any structure if it is capable of controlling an operation regarding image formation of the image-forming apparatus 100.

Criteria for determining absolute humidity are stored in the ROM 152. Based on the criteria for determining absolute humidity, by the controller 150, from the result of the detection of temperature and humidity in the temperature/humidity detecting device 90, absolute humidity in an installation environment of the image-forming apparatus 100 is determined. Additionally, in the RAM 153, a time and date (referred to as "time and date B") which is a time and date immediately before when the air-blowing device 80 previously stopped, an unused time which is calculated from the above time and date (the time and date B) and the present time and date (referred to as "time and date A"), and a waiting time (an initial value is 15 minutes) from when the previous image-forming operation ends until the air-blowing device 80 stops are stored. And furthermore, in the RAM 153, the present time and date used for calculating the waiting time and the unused time, and the like are also stored accordingly. Storing and updating of those values in the RAM 153 are performed by the controller 150.

Additionally, in the ROM 152, a relationship between those values stored in the RAM 153 and execution conditions for the polishing operation of the photoconductor drum 10 after being unused is stored. Based on the unused time, the absolute humidity, and the waiting time stored in the RAM 153, with reference to the ROM 152, the controller 150 determines execution conditions for controlled polishing operation, and stores them in the RAM 153.

In the image-forming apparatus 100 as structured above, when a print button (not shown) is pressed, the photoconductor drum 10 is rotationally driven in a clockwise direction as shown by reference sign A in FIG. 1. At this time, a surface of the photoconductor drum 10 is uniformly charged with a predetermined magnetic property by the charging device 20. On the other hand, the image information of the manuscript read by the image reader 110 is converted to an electric signal, and sent to the exposing device 140. In the exposing device 140, based on the image information converted to the electric signal, a laser beam L is modulated, and the charged surface of the photoconductor drum 10 is irradiated with the laser beam L by a polygon mirror.

The surface of the photoconductor drum 10 is thus exposed by the laser beam L of the exposing device 140, and therefore, on the surface of the photoconductor drum 10, an electrostatic latent image corresponding to the image information of the manuscript is formed. When passing through the developing device 30, the electrostatic latent image formed on the surface of the photoconductor drum 10 is visualized as a toner image (developing agent image) by toner supplied from the developing device 30, and the toner image is formed on the surface of the photoconductor drum 10.

On the other hand, from the paper feeder the transfer paper P is fed to the image-forming part. The transfer paper P is fed in a direction of an arrow C shown in FIG. 5 by the carrying device at a timing consistent with the toner image on the photoconductor drum 10. At this time, in the transferring part 41, the toner image formed on the surface of the photoconductor drum 10 is transferred on a surface of the transfer paper P by the operation of the transferring device 40.

The transfer paper P is continuously carried in the direction of the arrow C, separated from the photoconductor drum 10, and carried to the fixing device 70. By the fixing device 70, the toner image transferred on the transfer paper P is fixed to the transfer paper P. And then, the transfer paper P is discharged outside of the image-forming apparatus 100 as a copy paper by the carrying device.

Figure 5:
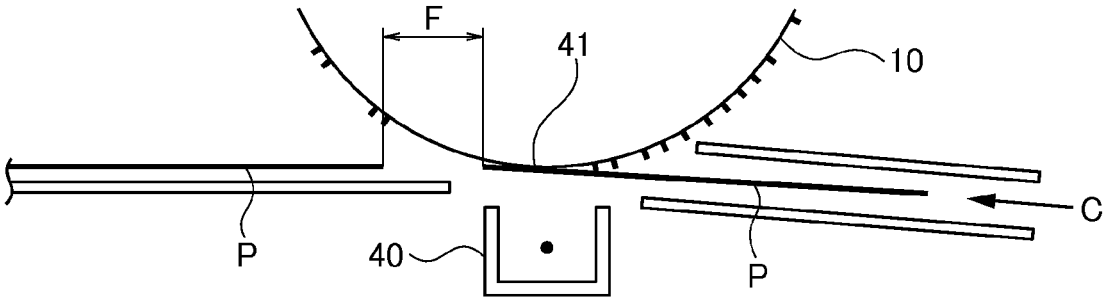
FIG. 5 is an explanatory diagram which explains a position of a transfer paper in a transferring device during an image-forming operation.

Please note that in a case where an image-forming operation is continuously executed on equal to or more than two transfer papers P, the equal to or more than two transfer papers P fed from the paper feeder are carried to the outside of the image-forming apparatus 100 in a state where a predetermined interval F as shown in FIG. 5 is provided.

On the other hand, on the surface of the photoconductor drum 10 after transferring the toner image, as shown in FIGS. 1, 2, and the like, toner which has not been transferred on an irradiated transfer paper P (hereinafter, referred to as "transfer residue toner T") is attached. The transfer residue toner on the photoconductor drum 10 is collected by the cleaning device 50, and the surface of the photoconductor drum 10 is cleaned.

Here, an amount of the toner transferred on the transfer paper P is approximately 80% of an amount of the toner of the toner image formed on the surface of the photoconductor drum 10, and the rest is transfer residue toner T. An operation of the discharging device 60 is performed on the surface of the photoconductor drum 10 after being cleaned, residue charge remaining on the surface is removed. And then the operation is returned to a charging step by the charging device 20 again, a serial image-forming operation described above is repeated.

Next, with reference to FIG. 2, an operation regarding the cleaning device 50 will be explained in detail. The core shaft 531 of the brush roller 53 is supported to be freely rotatable on front and rear side walls in an axial direction of the cleaning case 51, and is rotationally driven by a cleaning drive motor as one example of the cleaning driver 57. Therefore, a whole of the brush roller 53 is rotationally driven around a center axis line thereof.

The brush roller 53 is rotationally driven in a counterclockwise direction centering on the core shaft 531 as shown by an arrow B in FIG. 2. Additionally, the brush roller 53 rotates in a state where the brush 532 is in contact with the surface of the photoconductor drum 10. The cleaning blade 52 and the brush roller 53 extend long in an entire image region in an axial direction of the photoconductor drum 10.

To the cleaning device 50, the transfer residue toner T at the time of image formation, and toner of the toner image formed at the time of the polishing operation of the photoconductor drum 10 after being unused are inputted. When the toners are inputted to the cleaning device 50, the toners are blocked by the end edge part 522 of the cleaning blade 52, and scraped from the surface of the photoconductor drum 10.

The toners on the surface of the photoconductor drum 10 scraped by the cleaning blade 52 fall on a lower side on a page of FIG. 2, and are received by the brush 532 of the brush roller 53, and are carried in a direction separating from the surface of the photoconductor drum 10 by rotation of the brush roller 53.

The end 561 of the flicker bar 56 fixed on the inner surface of the upper wall of the cleaning case 51 is in contact with the brush 532. Therefore, the toners received by the brush 532 and carried by the rotation of the brush roller 53 are hit and fallen by the flicker bar 56, and released to the toner-eliminating member 54.

The toners released to the toner-eliminating member 54 are carried to the outside of the cleaning case 51 by the toner-eliminating member 54 rotating in a direction of an arrow D, sent to a collection tank (not shown), and stored in the collection tank.

Note that the cleaning drive motor as one example of the cleaning driver 57 starts driving concurrently with a photoconductor drive motor as one example of the photoconductor driver 11, and stops driving concurrently.

Next, in the present embodiment, a polishing operation after being unused of the photoconductor drum 10 after being unused by the controller 150 as a polishing operation controller after being unused will be explained. Whether the polishing operation after being unused is executed or not is determined by the controller 150 as the polishing operation controller based on the absolute humidity, the waiting time, and the unused time.

In a case where executing the polishing operation of the photoconductor drum 10 after being unused, the polishing operation starts when the power of the image-forming apparatus 100 is turned on, or when an operator operates the image-forming apparatus 100 during the power-saving mode, and the air-blowing device 80 starts operating. The polishing operation is executed during an execution time TM set in advance.

When the power is turned on, or when there is an operation by the operator during the power-saving mode, the photoconductor drum 10 is rotationally driven in the clockwise direction shown by reference sign A in FIG. 1, and the brush roller 53 of the cleaning device 50 is rotationally driven in the counterclockwise direction shown by reference sign B in FIG. 2. At this time, the surface of the photoconductor drum 10 is uniformly charged with a predetermined polarity by the charging device 20. The charged surface is irradiated with a laser beam L from the exposing device 140.

Figure 6:
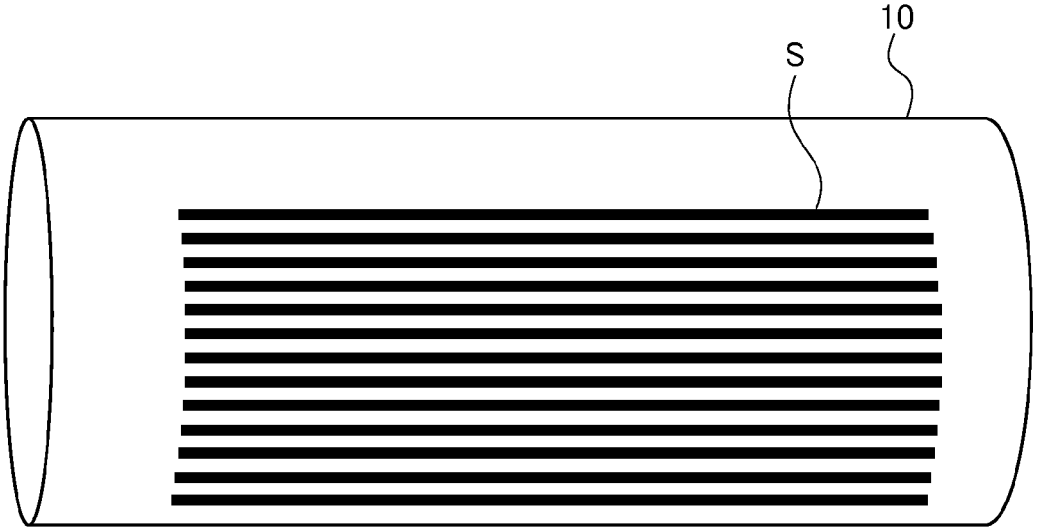
FIG. 6 is a schematic diagram which shows a shape of a toner image formed on a photoconductor drum while executing a polishing operation of the photoconductor drum, after being unused.

By this exposure, on the surface of the photoconductor drum 10, as shown in FIG. 6, an electrostatic latent image S, which includes a plurality of lines formed at constant intervals in the circumferential direction having a constant length (length in the axial direction of the photoconductor drum 10) and a constant width (length in the circumferential direction), is formed. When the electrostatic latent image S passes through the imaging device 30, the electrostatic latent image is visualized as a toner image, and the toner image is formed on the surface of the photoconductor drum 10 which is rotationally driven.

After the photoconductor drum 10 is started to be rotationally driven, an electrostatic latent image S and toner image formation is executed until a predetermined time T1 elapses. Until a predetermined time T2 elapses after the elapse of the predetermined time T1, the electrostatic latent image S and toner image formation is interrupted. Then, the electrostatic latent image S and toner image formation and interruption are repeatedly executed, and when reaching an execution time of the polishing operation after being unused, the electrostatic latent image S and toner image is ended, and rotation of the photoconductor drum 10 and the brush roller 53 is stopped. Please note that while executing the polishing operation after being unused, the transfer paper P is not fed, all the toners on the surface of the photoconductor drum 10 are inputted to the cleaning device 50, and collected by the cleaning device 50, and therefore, polishing (cleaning) of the photoconductor drum 10 is performed.

Figure 7:
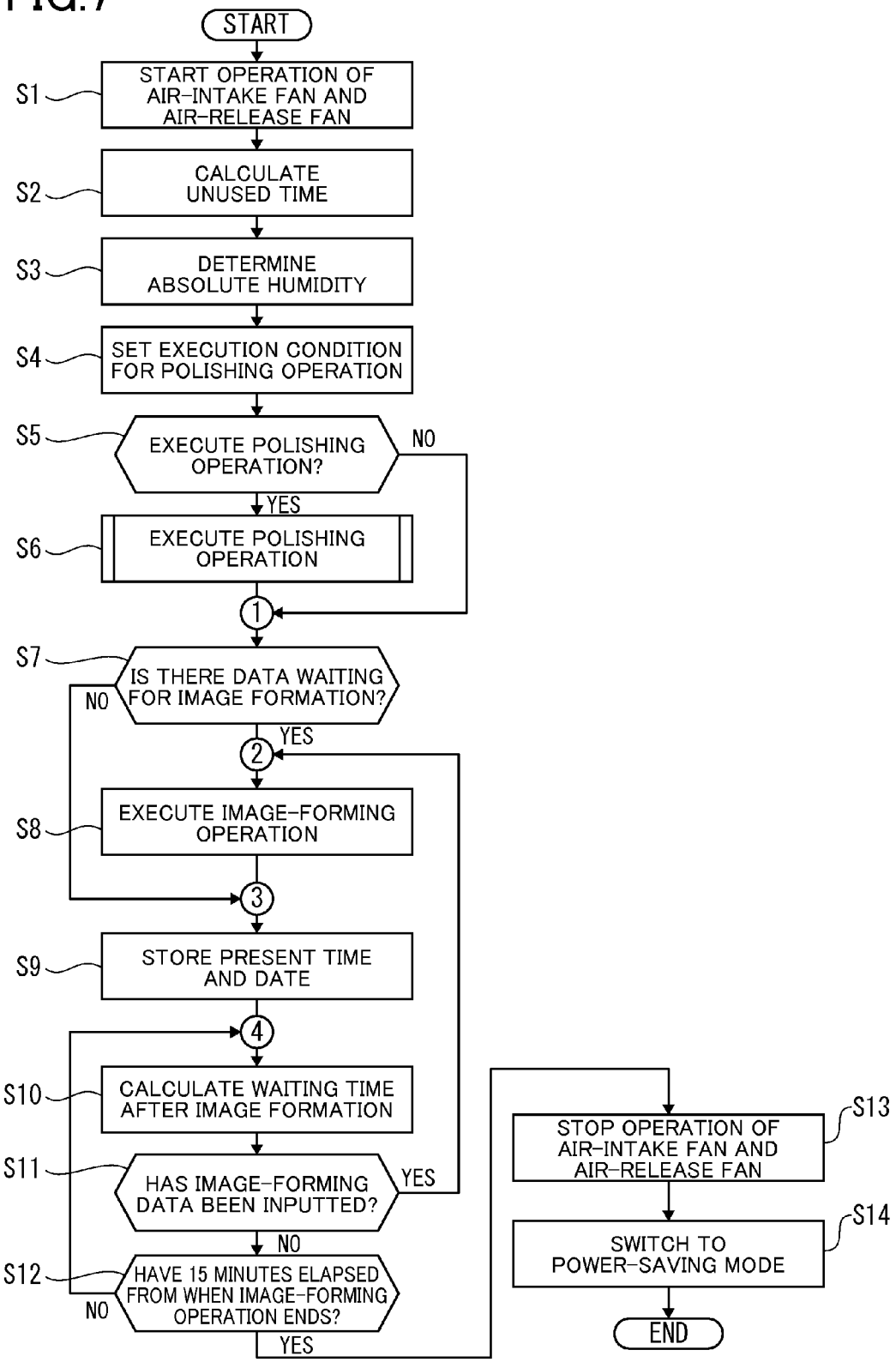
FIG. 7 is a flow diagram of the image-forming operation performed by the image-forming apparatus according to the first embodiment of the present invention.

Hereinafter, based on a flow diagram of FIG. 7, an image-forming operation of the image-forming apparatus 100 in the present embodiment, and at the time, a polishing operation of the photoconductor drum 10 after being unused which is executed depending on a case will be explained.

Firstly, when the power of the image-forming apparatus 100 is turned on, or after there is an operation by an operator during a power-saving mode, in step S1, operation of the air-intake fan 84 and the air-release fan 86 of the air-blowing device 80 is started.

In step S2, the controller 150 calculates an unused time of the image-forming apparatus 100.

In the RAM 153, a time and date B which is a time and date (time and date stored in later-described step S10) immediately before when the air-intake fan 84 and the air-release fan 86 previously stopped is stored. An elapsed time from the time and date B to a present time and date A is the unused time, and the controller 150 calculates the unused time from the time and date B and the time and date A, and stores it in the RAM 153.

In step S3, the controller 150 determines absolute humidity in an installation environment of the image-forming apparatus 100. In the ROM 152, contents of criteria for determining the absolute humidity shown in Table 1 of FIG. 9 are stored. A unit of numerical values in Table 1 is g/m$^3$. The controller 150 determines the absolute humidity in the installation environment based on the criteria for determining the absolute humidity, and a detection result of temperature and humidity (temperature (° C.) and humidity (%)) detected by the temperature/humidity detecting device 90. The determined absolute humidity is stored in the RAM 153 by the controller 150.

In step S4, based on the unused time calculated in step S2, the absolute humidity determined in step S2, and the waiting time stored in the RAM 153, the controller 150 sets execution conditions for the polishing operation of the photoconductor drum 10 after being unused. As to the waiting time stored in the RAM 153, an initial value is 15 minutes; however, in a case where the waiting time is calculated in step S10 at the time of the previous image-forming operation, it is updated to the calculated value.

In the ROM 152, as shown in Table 2 of FIG. 10, a relationship between values (unused time, absolute humidity, and waiting time) stored in the RAM 153 and the execution conditions for the polishing operation of the photoconductor drum 10 after being unused is stored. The controller 150 determines the execution conditions for the polishing operation based on the unused time, the absolute humidity, and the waiting time stored in the RAM 153, and stores them to the RAM 153.

More specifically, in the controller 150, based on Table 2 of FIG. 10, firstly, whether the polishing operation is executed based on the absolute humidity or not is determined. In a case where the absolute humidity is less than 12 g/m$^3$, it is determined not to operate the polishing operation. On the other hand, in a case where the absolute humidity is equal to or more than 12 g/m$^3$, then, based on the waiting time and the unused time, as shown in Table 2 of FIG. 10, it is determined whether or not to execute the polishing operation.

In a case of executing the polishing operation, the polishing operation is executed for the execution time TM set in Table 2.

In Table 2, the predetermined time T1 represents a time in which the electrostatic latent image S and toner image formation is executed, the predetermined time T2 represents a time in which the electrostatic latent image S and toner image formation is executed. Additionally, the number of rotations of brush roller represents the number of rotations of the brush roller 53 at the time of the polishing operation. In the present embodiment, the execution time (8 minutes), the predetermined time T1 (15 seconds), the predetermined time T2 (45 seconds), and the number of rotations of the brush roller (420 rpm) of the polishing operation are constant, respectively.

In step S5, whether the execution conditions for the polishing operation of the photoconductor drum 10 after being unused determined in step S4 is "executed" or "not executed" is determined. In a case where it is determined to be "executed" (in case of YES), the operation proceeds to step S6, and the polishing operation is executed in accordance with the above execution conditions, and then step S7 is executed. On the other hand, in a case where it is determined to be "not executed" (in case of NO), the operation is skipped over the polishing operation in step S6 to "1" in the flow diagram of FIG. 7, and then step S7 is executed.

In step S7, whether there is data waiting for image formation or not is determined. For example, the data waiting for image formation is referred to as image data which is inputted when the power of the image-forming apparatus 100 is turned on by execution of copying, or execution of output of a printer during the power-saving mode, or image data which is in a state of waiting for image formation during the polishing operation by request for image formation while the power is turned on and the polishing operation after being unused is performed. Existence or non-existence of the data waiting for image formation is determined by whether or not such image data is accumulated in the image processor 120. In a case where there is image data waiting for image formation (in case of YES), in step S8, the image-forming operation is executed, and the operation proceeds to step S9. In a case of there is no image data waiting for image formation (in case of NO), the operation is skipped over step S8 to "3" in the flow diagram, and step 9 is executed.

Next, in step S9, as a time and date when the operation so far ends (for example, in a case where the image-forming operation is executed in step 8, it is when the image-forming operation ends), a present time and date is stored in the RAM 153. In step S10, an elapsed time from the time and date when the operation ends stored in step S9 to the present time and date is calculated, and stored in the RAM 153 as a waiting time after image formation, and the present time and date is stored in the RAM 153 as the time and date B when the air-intake fan 84 and the air-release fan 86 stopped. The time and date B is referenced at the time of a next image-forming operation.

In step S11, whether image-forming data has "been inputted" or "not been inputted" is determined. In a case where it is determined that the image-forming data has "been inputted" (in case of YES) by the execution of copying and the execution of output of the printer, the operation is skipped to "2" in the flow diagram, and returned to step S8. On the other hand, in a case where it is determined that the image-forming data has "not been inputted" (in case of NO), step S12 is executed.

In step S12, whether "15 minutes have elapsed" or "15 minutes have not elapsed" is determined from when the image-forming operation ends. In a case where it is determined that "15 minutes have elapsed" from when the operation ends (in a case of YES), step S13 is executed. On the other hand, in a case where it is determined that "15 minutes have not elapsed" (in case of NO) from when the operation ends, the operation is skipped to "4", and then returned to step S10, and calculation and storage of a waiting time after the image formation are performed, and determination of existence or non-existence of input of the image-forming data (step S11), and determination whether 15 minutes have elapsed or not from the time and date when the operation ends (step S12) are repeatedly performed. That is, those operations are repeated, and therefore, during a waiting time from a time when operations such as the image-forming operation end until 15 minutes have elapsed, removal of the ozone or the like is performed by the air-blowing device 80.

In step S13 which is executed after an elapse of 15 minutes from the end of the operation (for example, the end of the image-forming operation), the operation of the air-intake fan 84 and the air-release fan 86 is stopped. In step S14, the image-forming apparatus 100 is switched to the power-saving mode. When the image-forming apparatus 100 is in the power-saving mode, until an operation is started by an operator starts, the image-forming apparatus 100 is in a state where the power is not supplied to other than the controller 150.

As described above, in a case where the operator does not turn the power off, or in a case where the image-forming apparatus 100 is not switched to the power-saving mode, after a waiting time which is stored in the RAM 153 has become 15 minutes, the image-forming apparatus 100 is switched to the power-saving mode. However, in a case where the power is turned off, or the image-forming apparatus 100 is switched to the power-saving mode before 15 minutes elapse from the time when the operation ends, the waiting time becomes less than 15 minutes, and in the RAM 153, the waiting time which is less than 15 minutes calculated in step S10 is stored.

Figure 8:
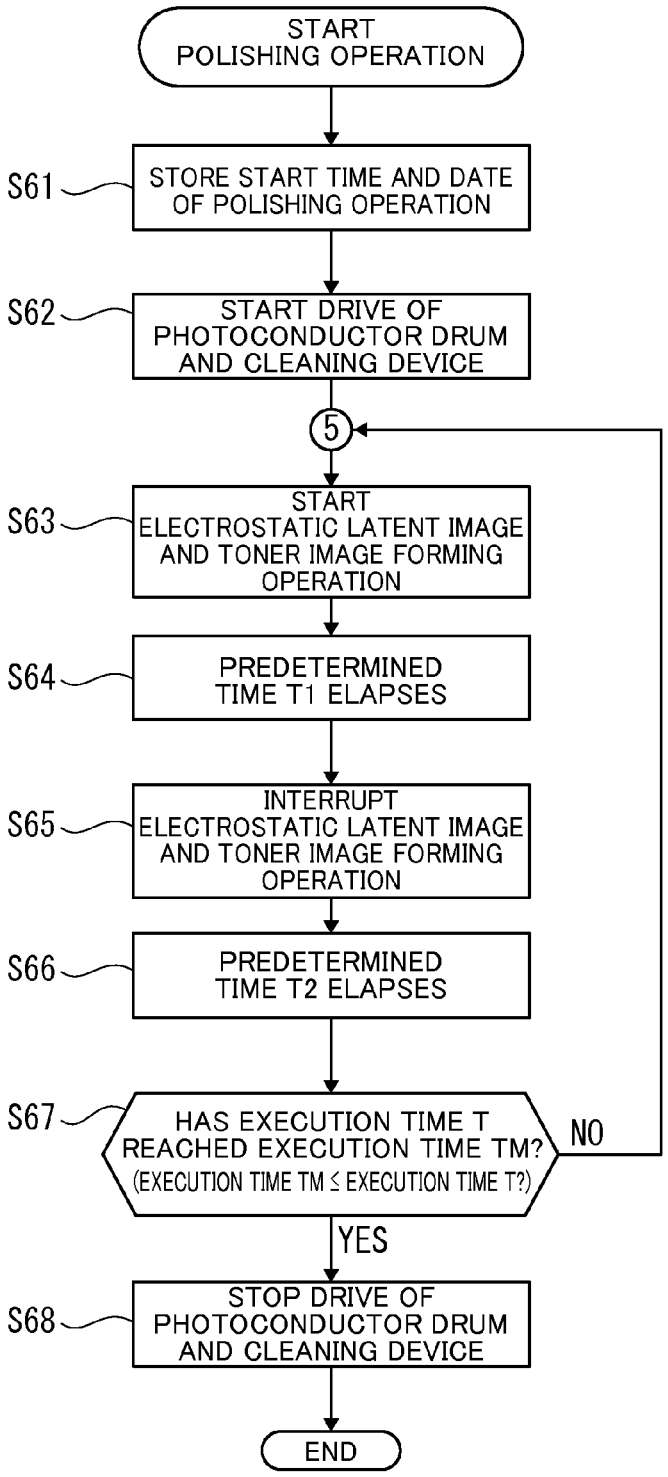
FIG. 8 is a flow diagram of the polishing operation of the photoconductor drum after being unused.

Next, with reference to a flow diagram of FIG. 8, details of a polishing operation in step S6 will be explained. When the polishing operation is started, firstly, in step S61, a start time and date TS of the polishing operation is stored.

Next, in step S62, the photoconductor drum 10 and the brush roller 53 of the cleaning device 50 are started to be rotationally driven. In step S63, as shown in FIG. 6, a forming operation of an electrostatic latent image S to a toner image on the surface of the photoconductor drum 10 is started. The forming operation of the electrostatic latent image S to the toner image is continued until the predetermined time T1 stored in the RAM 153 elapses (step S64).

In step S65, the forming operation of the electrostatic latent image S to the toner image is interrupted. The interruption of the electrostatic latent image S and toner image forming operation is continued until the predetermined time T2 stored in the RAM 153 elapses (step S66).

In step S67, whether an execution time T of a running polishing operation has reached the execution time TM set in advance and stored in the RAM 153 or not (execution time TM≤execution time T) is determined. The execution time T of the running polishing operation is calculated from an elapsed time from the start time and date TS of the polishing operation stored in the RAM 153 in step S61.

In a case where it is determined that the execution time of the running polishing operation has reached the execution time TM stored in the RAM 153 (in case of YES), step S68 is executed. On the other hand, in a case where it is determined that the execution time of the running polishing operation has not reached the execution time TM (in case of NO), the operation is skipped to "5" in the flow diagram, and returned to step S63.

In step S68, the photoconductor drum 10 and the brush roller 53 of the cleaning device 50 are finished being rotationally driven, and the polishing operation is finished.

In the image-forming apparatus 100 according to the first embodiment, based on the absolute humidity, the waiting time, and the unused time, the polishing operation of the photoconductor drum 10 after being unused is executed. Therefore, it is possible to suppress toner to be consumed unnecessarily, and a waiting time until the image-forming operation starts to be unnecessarily lengthened. As a result, it is possible to effectively perform the polishing operation after being unused, and favorably suppress image deletion or the like, and therefore, it is possible to improve an image quality.

For example, when immediately after the image formation an operator turns the power off, or the image-forming apparatus 100 is switched to the power-saving mode, the air-blowing device 80 does not operate for the certain time, and therefore, the removal of the ozone, discharge product, floating toner, and the like is not sufficiently performed, and there often is a case where the image deletion tends to occur. Even in such a case, in the image-forming apparatus 100 according to the present embodiment, the polishing operation after being unused is reliably performed based on the execution conditions corresponding to such a case, and therefore, it is possible to favorably prevent the image deletion, and suppress deterioration of the image quality.

Hereinbefore, one embodiment (first embodiment) of the present invention has been explained, the present invention is not limited thereto.

Hereinafter, second to fourth embodiments in which the execution conditions for the polishing operation of the photoconductor drum 10 after being unused is varied will be explained. In each of the second to fourth embodiments, an image-forming apparatus 100 having a similar structure to that in the first embodiment is used, except the execution condition for the polishing operation of the photoconductor drum 10 after being unused is varied. Therefore, detailed explanation of the structure of the image-forming apparatus 100 of each of the second to fourth embodiments, an image-forming operation is omitted.

Second Embodiment

Firstly, a second embodiment will be explained. In Table 3 shown in FIG. 11, a relationship between values in the RAM 153 and execution conditions for the polishing operation of the photoconductor drum 10 after being unused in the second embodiment is shown. In the second embodiment, the polishing operation is executed based on the execution conditions shown in Table 3.

As shown in Table 3 of FIG. 11, in the second embodiment, in a case where the absolute humidity is less than 12 g/m$^3$, the polishing operation of the photoconductor drum 10 after being unused is not executed. On the contrary, in a case where the absolute humidity is equal to or more than 12 g/m$^3$, based on the waiting time and the unused time, whether the polishing operation is executed or not is determined, and in case where the polishing operation is executed, the execution time TM is determined based on Table 3. Please note that also in the second embodiment, the predetermined time T1 (time in which the forming operation of the electrostatic latent image S to the toner image is performed), the predetermined time T2 (time in which the forming operation of the electrostatic latent image S to the toner image is interrupted), and the number of rotations of the brush roller 53 are constant, respectively.

In the second embodiment, the execution time TM of the polishing operation after being unused is set to be 3 to 8 minutes. In a case where the absolute humidity and the waiting time are constant, respectively, as the unused time is shorter, the execution time TM is set to be shorter.

According to the second embodiment, the execution time TM of the polishing operation after being unused is minimized, and therefore, it is possible to suppress a downtime (time in which it is not possible to perform image formation due to the execution of the polishing operation) at minimum. Therefore, it is possible to effectively perform the polishing operation after being unused, and the image deletion or the like is favorably suppressed, and it is possible to improve the image quality of the image-forming apparatus 100.

Third Embodiment

Next, a third embodiment will be explained. In Table 4 shown in FIG. 12, a relationship between values in the RAM 153 and execution conditions for the polishing operation of the photoconductor drum 10 after being unused in the third embodiment is shown. In the third embodiment, the polishing operation is executed based on the execution conditions shown in Table 4.

As shown in Table 4 of FIG. 12, in the third embodiment, in a case where the absolute humidity is less than 12 g/m$^3$, it is determined that the polishing operation of the photoconductor drum 10 after being unused is not executed. On the contrary, in a case where the absolute humidity is equal to or more than 12 g/m$^3$, based on the waiting time and the unused time, whether the polishing operation is executed or not is determined, and in a case where the polishing operation is executed, the execution time TM, the predetermined time T1, the predetermined time T2 are determined based on Table 4.

In the third embodiment, the execution time TM of the polishing operation after being unused is set to be 2 to 5 minutes. Also in the third embodiment, as in the second embodiment, in a case where the absolute humidity and the waiting time are constant, respectively, and only the unused time is variable, as the unused time is longer, the execution time TM is set to be longer in proportion to the unused time.

Additionally, in the third embodiment, in a case where the absolute humidity is variable, as the absolute humidity is higher, the predetermined time T1 in which the toner image is formed is set to be longer. That is, in a case where the absolute humidity is equal to or more than 16 g/m$^3$, compared to a case where the absolute humidity is 12 to 15.9 g/m$^3$, the predetermined time T1 in which the toner image is formed is set to be longer, and the predetermined time T2 which is an interruption time is set to be shorter. Accordingly, a use amount of toner during the polishing operation after being unused increases, and polishing performance of the photoconductor drum 10 improves.

Thus, in the third embodiment, in a case where the absolute humidity is high, it is possible to improve the polishing performance of the photoconductor drum 10 by increasing the use amount of toner. Therefore, compared to a device in which a use amount of toner is constant, it is possible to shorten the execution time of the polishing operation of the photoconductor drum 10 after being unused.

According to the third embodiment, based on the absolute humidity, the waiting time, and the unused time, the execution time of the polishing operation of the photoconductor drum 10 after being unused is varied, and the use amount of toner when the polishing operation is executed is varied. Therefore, it is possible to increase the polishing performance, and shorten the execution time of the polishing operation in a case where the absolute humidity is comparatively high and the waiting time is comparatively short.

Additionally, in a case where the absolute humidity is comparatively low, it is possible to reduce a consumption amount of toner. Therefore, it is possible to make the use amount of toner and the polishing time the minimum necessary, and effectively perform the polishing operation after being unused, and the image deletion or the like is favorably suppressed, and therefore, it is possible to improve the image quality of the image-forming apparatus 100.

Fourth Embodiment

Next, a fourth embodiment will be explained. In Table 5 shown in FIG. 13, a relationship between values in the RAM 153 and execution conditions for the polishing operation of the photoconductor drum 10 after being unused in the fourth embodiment is shown.

In the fourth embodiment, the polishing operation is executed based on the execution conditions shown in Table 5. In the fourth embodiment, the number of rotations of the brush roller 53 of the cleaning device 50 is set to be 630 rpm which is 1.5 times that at the time of a usual image formation (420 rpm).

In the cleaning device 50, a linear speed of the brush roller 53 in the brush 532 which is in contact with the surface of the photoconductor drum 10 is taken as V1, a linear speed of the surface of the photoconductor drum 10 is taken as V2, and a difference between both speeds (V1-V2) is taken as V3. When increasing a value of the difference V3 between both speeds, an external force to the surface of the photoconductor drum 10 received by the brush 532 is increased, and polishing performance for removing foreign matters such as toner, a discharge product, and the like stuck on the surface of the photoconductor drum 10 is improved. However, when the photoconductor drum 10 is continuously used with the value of V3 being large, a photosensitive layer of the surface of the photoconductor drum 10 is abraded to the limit early, and a life of the photoconductor drum 10 is extremely shortened, and therefore, it is difficult to continue to use the photoconductor drum 10 with the value of V3 being large.

Therefore, in the fourth embodiment, only when the polishing operation of the photoconductor drum 10 after being unused is executed, the number of rotations of the brush roller 53 is 1.5 times that during a usual image-forming operation. Accordingly, the value of V3 when the polishing operation of the photoconductor drum 10 after being unused is increased to a degree which does not shorten a life, and the polishing performance of the photoconductor drum 10 when this polishing operation is executed is improved.

As shown in Table 5 of FIG. 13, also in the fourth embodiment, in a case where the absolute humidity is less than 12 g/m$^3$, it is determined that the polishing operation of the photoconductor drum 10 after being unused is not executed. On the contrary, in a case where the absolute humidity is equal to or more than 12 g/m$^3$, based on the waiting time and the unused time, whether the polishing operation of the photoconductor drum 10 after being unused or not is determined, and the execution time TM, the predetermined time T1, the predetermined time T2, and the number of rotations of the brush roller 53 are determined.

Also in the fourth embodiment, as in the third embodiment, in a case where the absolute humidity and the waiting time are constant, respectively, and only the unused time is variable, as the unused time is longer, the execution time TM is set to be longer. Additionally, in a case where the absolute humidity is variable, as the absolute humidity is higher, the predetermined time T1 in which the toner image is formed is set to be longer. That is, in a case where the absolute humidity is equal to or more than 16 g/m$^3$, compared to the case where the absolute humidity is 12 to 15.9 g/m$^3$, the predetermined time T1 in which the toner image is formed is set to be longer, and the predetermined time T2 which is the interruption time is set to be shorter. Accordingly, the use amount of toner during the polishing operation after being unused is increased, and the polishing performance of the photoconductor drum 10 is improved. Further, in the fourth embodiment, the number of rotations of the brush roller 53 of the cleaning device 50 is set to be 1.5 times that in a normal case (the third embodiment, or the like), and the polishing operation of the photoconductor drum 10 is improved. Therefore, an excellent preventive effect for the image deletion is obtained, and it is possible to shorten the execution time TM of the polishing operation compared to the normal case.

More specifically, in a case where the absolute humidity is 12 to 15.9 g/m$^3$, and in a case where the absolute humidity is equal to or more than 16 g/m$^3$ and the waiting time is equal to or more than 15 minutes, in the third embodiment, the execution time TM of the polishing operation after being unused is 3 minutes or 5 minutes corresponding to the length of the time being unused. On the contrary, in the fourth embodiment in which the polishing performance is improved, it is possible to shorten the execution time TM to be 2 minutes or 4 minutes.

Additionally, in a case where the absolute humidity is equal to or more than 16 g/m$^3$ and the waiting time is less than 15 minutes, in the fourth embodiment, compared to the third embodiment, it is possible to set the predetermined time T1 in which the toner image is formed to be shorter, and set the predetermined time T2 which is the interruption time to be longer. Therefore, compared to the third embodiment, it is possible to reduce the use amount of toner.

As described above, in the fourth embodiment, by increasing the number of rotations of the brush roller 53 of the cleaning device 50, the polishing performance of the photoconductor drum 10 is improved. Therefore, compared to the third embodiment, by shortening the predetermined time T1 in which the toner image is formed, the use amount of toner is reduced, and the execution time TM of the polishing operation is shortened. Therefore, it is possible to make the use amount of toner and the polishing time the minimum necessary, and effectively perform the polishing operation, and the image deletion or the like is favorably suppressed, and accordingly, it is possible to improve the image quality of the image-forming apparatus 100.

Additionally, in each of the first to fourth embodiments, the image-forming apparatus 100 to which the monochrome image-forming apparatus by which only the black toner image is formed on the transfer paper P is applied has been explained; however, an image-forming apparatus to which the image-forming apparatus 100 according to each embodiment of the present invention is applied is not limited thereto. For example, to a color copier in which image bearers corresponding to yellow, magenta, cyan, and black colors are provided, respectively, and developing devices, charging devices, cleaning devices, and the like are arranged for the image bearers corresponding to the colors, respectively, and a full-color image is formed by transferring a color toner image formed by each of the image bearers of each color to a transfer paper, the image-forming apparatus 100 according to each embodiment of the present invention can be applied. Additionally, To a so-called intermediate transfer type full-color image-forming apparatus in which a color toner image formed by each of the image bearers of each color is overlapped with each other on an intermediate transfer body to form a full-color image, the full-color image formed on the intermediate transfer body is transferred on a transferred medium, and then the full-color image is formed on the transferred medium, the image-forming apparatus 100 according to each embodiment of the present invention is applied.

According to the embodiments of the present invention, it is possible to make the use amount of the developing agent and the waiting time the minimum necessary, effectively perform the polishing operation of the image bearer after being unused, favorably suppress the image deletion or the like, and improve the image quality.

Although the present invention has been described in terms of exemplary embodiments, it is not limited thereto. It should be appreciated that variations may be made in the embodiments described by persons skilled in the art without departing from the scope of the present invention as defined by the following Claims.

What is claimed is:

1. An image-forming apparatus comprising:

an image bearer;

a cleaning device to clean a surface of the image bearer;

an air-blowing device to blow outside air;

a temperature/humidity detector to detect temperature and humidity outside of the image-forming apparatus; and a controller to determine absolute humidity from detected temperature and humidity, wherein, based on the absolute humidity, a waiting time from a time when a previous image-forming operation ends until the air-blowing device stops, in a stand-by state of an image-forming operation, and an unused time from a time when the air-blowing device stops until the air-blowing device resumes, the controller determines whether or not a polishing operation of the image bearer by the cleaning device after the air-blowing device is unused is executed in starting the operation of the blowing device.

2. The image-forming apparatus according to claim 1, wherein the controller determines an execution time of the polishing operation of the image bearer based on the absolute humidity, the waiting time, and the unused time.

3. The image-forming apparatus according to claim 2, wherein in a case where the absolute humidity and the waiting time are constant, respectively, and only the unused time is variable, the controller sets the execution time in proportion to the unused time.

4. The image-forming apparatus according to claim 1, wherein based on the absolute humidity, the waiting time, and the unused time, during the polishing operation of the image bearer, the controller determines an amount of developing agent of a developing agent image formed on the image bearer.

5. The image-forming apparatus according to claim 4, wherein in a case where the absolute humidity is equal to or more than a predetermined value, as the waiting time is shorter, the controller increases the amount of developing agent of the developing agent image formed on the image bearer, and sets the execution time of the polishing operation to be longer, and in a case where the absolute humidity is less than the predetermined value, the controller reduces the amount of developing agent of the developing agent image formed on the image bearer, compared to the case where the absolute humidity is equal to or more than the predetermined value.

6. The image-forming apparatus according to claim 1, wherein the cleaning device includes a cleaning brush, and a cleaning brush driver, and the controller controls the cleaning brush driver such that the number of rotations of the cleaning brush at the time of the polishing operation of the image bearer after being unused is increased more than that during the image-forming operation.

7. The image-forming apparatus according to claim 6, wherein in a case where the absolute humidity is equal to or more than a predetermined value, the controller sets an amount of developing agent of a developing agent image formed on the image bearer to be more than that in a case where the absolute humidity is less than the predetermined value, and sets an execution time of the polishing operation to be longer than that in the case where the absolute humidity is less than the predetermined value.

8. The image-forming apparatus according to claim 1, further comprising a charging device to charge the image bearer, wherein the air-blowing device includes an air blower which supplies outside air to the charging device, a filter which removes a foreign matter in the outside air, an air releaser which releases air in the charging device, a filter which removes a foreign matter from the charging device, and a duct which forms an airflow path, and the air-blowing device operates when the image-forming apparatus starts operating, and stops after an elapse of a predetermined time from when an image-forming operation ends.

9. An image-forming method of employing the image-forming apparatus according to claim 1, comprising:

preparing an image bearer; a cleaning device to clean a surface of the image bearer; an air-blowing device to blow outside air; a temperature/humidity detector to detect temperature and humidity outside of the image-forming apparatus; and a controller to determine absolute humidity from detected temperature and humidity, detecting a temperature and humidity in an environment in which the image-forming apparatus is installed by the temperature/humidity detecting device;

detecting a waiting time from when a previous image-forming operation ends until the air-blowing device stops, in a stand-by state of an image-forming operation;

detecting a unused time from when the air-blowing device stops until the air-blowing device resumes; and determining by the controller whether executing a polishing operation of the image bearer by the cleaning device after the air-blowing device is unused in starting the operation of the blowing device, based on the absolute humidity, the waiting time and the unused time.

* * * * *